US006067910A

United States Patent [19]

Theurer et al.

[11] Patent Number: 6,067,910

[45] Date of Patent: May 30, 2000

[54] BALLAST TAMPING ASSEMBLY

[75] Inventors: Josef Theurer, Vienna; Friedrich Peitl, Linz, both of Austria

[73] Assignee: Franz Plasser Bahnbaumaschinen Industriegesellschaft mbH, Vienna, Austria

[21] Appl. No.: 09/152,832

[22] Filed: Sep. 14, 1998

[30] Foreign Application Priority Data

Oct. 14, 1997 [AT] Austria ..... 1740

[51] Int. Cl.[7] ..... E01B 27/16

[52] U.S. Cl. ..... 104/12; 104/10

[58] Field of Search ..... 104/10, 12

[56] References Cited

U.S. PATENT DOCUMENTS 4,537,135 8/1985 Theurer ..... 104/12

5,269,226 12/1993 Theurer et al. ..... 104/12

*Primary Examiner*—S. Joseph Morano

*Assistant Examiner*—Lars A. Olson

*Attorney, Agent, or Firm*—Horst M. Kasper

[57] ABSTRACT

An assembly for tamping ballast supporting a track having two rails fastened to ties comprises a vertically adjustable tamping tool carrier and a pair of tamping tools mounted on the carrier for reciprocation towards and away from one another in the longitudinal direction of the track, each of the tamping tools being pivotal about a swivel axis extending in the direction of elongation of the ties and including at least one tamping pick arranged at the lower end of the tamping tool and intended for immersion in the ballast upon vertical adjustment of the tamping tool carrier, the tamping pick being mounted on the tamping tool for pivoting about a pivot axis extending perpendicularly to the swivel axis. A pivot drive designed as a hydraulic cylinder is connected to the tamping pick for pivoting the same in the direction of elongation of the ties, and an auxiliary drive is connected to the pivot drive, the pivot drive and the auxiliary drive each being linked to a respective one of two hinging points associated with the tamping tool and the tamping pick, respectively. A squeezing drive is provided for reciprocating the tamping tools in the longitudinal direction.

5 Claims, 2 Drawing Sheets

BALLAST TAMPING ASSEMBLY

BACKGROUND OF THE INVENTION

1. Field of the Invention

The present invention relates to an assembly for tamping ballast supporting a track having two rails extending in a longitudinal direction which are fastened to a succession of ties, the tamping assembly comprising a vertically adjustable tamping tool carrier and a pair of tamping tools mounted on the carrier for reciprocation towards and away from one another in the longitudinal direction, each of the tamping tools being pivotal about a swivel axis extending in the direction of elongation of the ties and including at least one tamping pick arranged at the lower end of the tamping tool and intended for immersion in the ballast upon vertical adjustment of the tamping tool carrier, the tamping pick being mounted on the tamping tool for pivoting about a pivot axis extending perpendicularly to the swivel axis. A pivot drive designed as a hydraulic cylinder is connected to the tamping pick for pivoting the same in the direction of elongation of the ties, and squeezing drives are provided for reciprocating the tamping tools in the longitudinal direction.

2. Description of the Prior Art

U.S. Pat. No. 4,537,135 discloses a ballast tamping assembly designed especially for operation in switch areas of a track. Each tamping tool of this assembly comprises two tamping picks for immersion in the ballast which are arranged adjacent one another in the direction of elongation of the ties. A separate pivot drive is associated with each of said two tamping picks, thus providing a high degree of adaptability of the tamping picks which may be laterally pivoted out of the way to avoid colliding with various obstacles often present in switch areas. Depending on requirements, one or both tamping picks may be swivelled upwards into an inoperative position.

Another ballast tamping assembly is known from U.S. Pat. No. 5,269,226, likewise having two tamping picks per tamping tool which are arranged side-by-side in the longitudinal direction of the ties. The tamping pick closer to the rail of the track to be tamped is fixedly connected to the tamping tool, while the adjacent tamping pick may be pivoted by means of a pivot drive from a first to a second operating or end position. Both end positions are precisely delimited by respective stops. Thus, in a time-saving manner, the tamping tools need no longer be centered by the operator.

SUMMARY OF THE INVENTION

It is the primary object of this invention to improve a ballast tamping assembly of the first-described type in such a manner that the tamping picks may be adapted to varying operating conditions with particular swiftness and ease.

The above and other objects are accomplished according to the invention with such a ballast tamping assembly by connecting an auxiliary drive to the pivot drive, and by linking the pivot drive and the auxiliary drive each to a respective one of two hinging points associated with the tamping tool and the tamping pick, respectively.

This particular design of the pivot drive enables the tamping pick to be adjusted very quickly to a variety of operating positions while requiring only a minimum of additional structural expense. It is a particular advantage of this arrangement that the operator need not expend time and concentration to perform a repeated, tiresome centering operation of the tamping pick before every tamping sequence. As the new working position of the tamping pick is accurately defined by the limits of the piston stroke of the pivot and/or the auxiliary drive, the embodiment according to the invention is particularly suited for application in track areas presenting differing conditions for tamping which might even, on occasion, require one of the tamping picks to be taken out of operation entirely. This might be the case, for example, when guard rails or check rails are present in a section of track.

Preferably, the auxiliary drive is designed as a hydraulic cylinder and arranged to extend parallel to the pivot drive, with two of said auxiliary drives being arranged symmetrically with respect to a plane extending perpendicularly to the pivot axis and in the direction of elongation of the pivot drive. This provides a very effective and space-saving arrangement well suited for mounting in the limited space available on tamping assemblies. According to a preferred feature, the assembly may further comprise a connecting plate mounted to the hydraulic cylinder of the pivot drive, with both auxiliary drives being fastened to the connecting plate. Additionally, the piston stroke length of the auxiliary drive may be designed for pivoting the tamping pick from a first to a second operating position. This creates a particularly stable and structurally robust arrangement which is very dependable in operation and enables a rapid and accurate adjustment of the tamping pick to take place between any one of two operating positions as well as an inoperative position.

BRIEF DESCRIPTION OF THE DRAWING

The above and other objects, advantages and features of the present invention will become more apparent from the following detailed description of a now preferred embodiment thereof, taken together with the accompanying, somewhat schematic drawing wherein.

DETAILED DESCRIPTION OF PREFERRED EMBODIMENT

Figure 1:
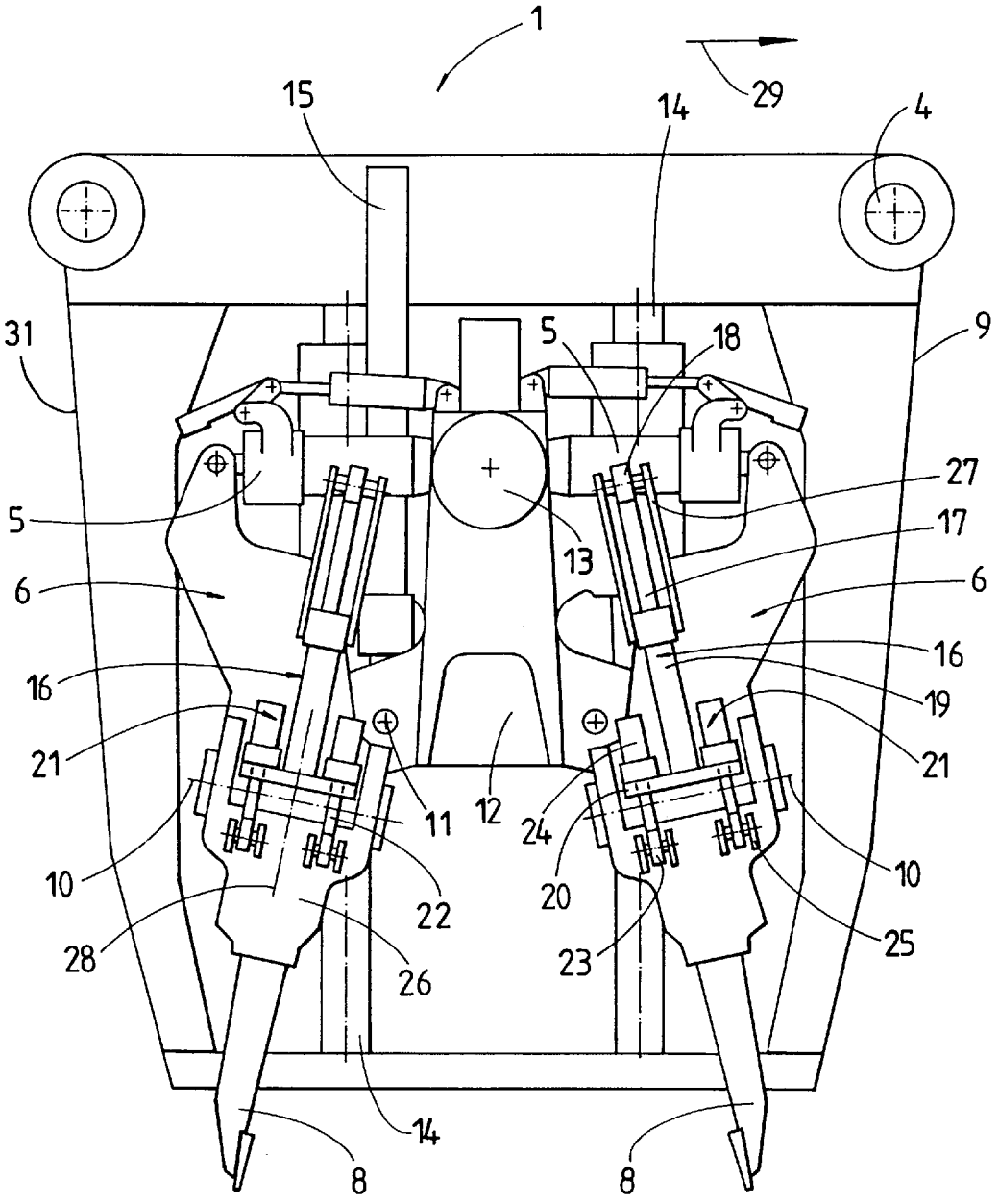
FIG. 1 is a side elevational view of an assembly for tamping ballast supporting a track.
Figure 2:
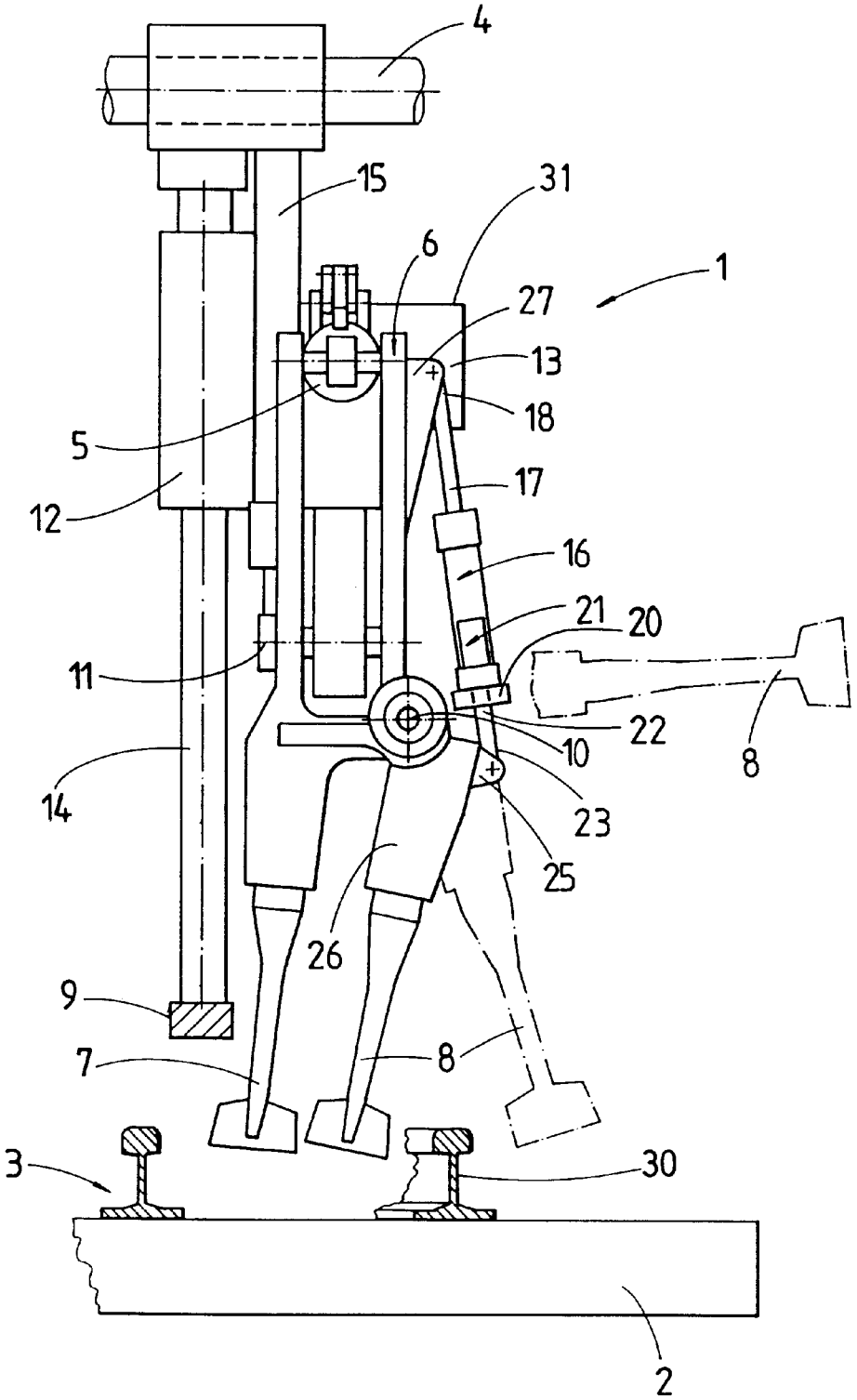
FIG. 2 is a fragmentary end view, partly in section, of the tamping assembly of FIG. 1.

Referring now to the drawing, FIGS. 1 and 2 show an assembly 1 for tamping ballast supporting a track 3 having two rails 30 extending in a longitudinal direction which are fastened to a succession of ties 2. The assembly 1 is mounted on a mobile tamping machine (not shown) and is designed especially for operation in switch sections of track 3. The assembly is composed of a total of four tamping units 31 (only one of the four identical units being shown in FIG. 2) arranged for transverse displacement on guide columns 4 connected to the machine. These guide columns extend perpendicularly to the longitudinal direction or the direction of machine elongation, indicated by an arrow 29.

The assembly 1, or rather each tamping unit 31, comprises a support frame 9 and two lever-shaped tamping tools 6, lying opposite one another in the direction of machine elongation or the longitudinal direction and designed for reciprocation towards and away from one another by means of a respective squeezing drive 5. To that end, the tamping tools 6 are mounted on a tamping tool carrier 12 for pivoting about a swivel axis 11 extending horizontally and perpendicularly to the longitudinal direction. Each tamping tool 6 is connected in its lower end region to two tamping picks 7 and 8, of which the tamping pick spaced farther from the support frame 9 is mounted for pivoting about a pivot axis 10 extending in the longitudinal direction. The tamping tool carrier 12 is equipped with a vibrating drive 13 for mounting the squeezing drives 5 and for vibrating the tamping picks 7,8 and is vertically adjustable on guides 14 by means of a drive 15. The swivel axis 11 and the pivot axis 10 extend at right angles to one another.

A hydraulic pivot drive 16 is provided for pivoting the tamping pick 8, spaced at a greater distance from the support frame 9, in the direction of elongation of the ties. The pivot drive 16 comprises a hydraulic cylinder 19 and a piston rod 17 having a hinging point 18. The end of the hydraulic cylinder 19 remote from the hinging point 18 is fastened to a connecting plate 20 on which two hydraulic auxiliary drives 21 are mounted. Each of the auxiliary drives 21 comprises a hydraulic cylinder 24 which is fastened to the connecting plate 20, and a piston rod 22 having a hinging point 23. These hinging points of the auxiliary drives 21 are connected to hinging points 25 located on a pick mount 26 which is pivotable about the pivot axis 10 and on which the tamping pick 8 is mounted. The piston rod 17 of the pivot drive 16 is attached to hinging points 27 located on the tamping tool 6.

The two auxiliary drives 21 or rather their longitudinal axes are oriented parallel to the longitudinal axis of the pivot drive 16. Additionally, the two auxiliary drives 21 are arranged symmetrically with respect to a plane 28 extending perpendicularly to the pivot axis 10 and in the direction of elongation of the pivot drive 16.

In FIG. 2, a first operating position of the pivotably mounted tamping pick 8 is shown in full lines, in which the tamping pick is positioned immediately adjoining the adjacent tamping pick 7 transversely of the direction of machine elongation. This operating position is used for tamping work in normal, regular track situations, with both tamping picks 7 and 8 being immersed in the ballast at the same time. In this first operating position of the tamping pick 8, the piston rod 17 of the pivot drive 16 as well as the two piston rods 22 of the auxiliary drives 21 are in an extended position.

The pivotably mounted tamping pick 8 can be swivelled very quickly from the first operating position into a second operating position (shown in phantom lines) by retracting the two piston rods 22 the two auxiliary drives 21. This conversion of operating positions is very advantageous especially in a situation where an auxiliary rail or a switch tongue is present.

Finally, the pivotably mounted tamping pick 8 may also be pivoted upwards into an inoperative position (shown in phantom lines) by retraction of the piston rod 17 of the pivot drive 16. This is useful above all in areas where there is not enough free space to permit both tamping picks 7 and 8 to be immersed in the ballast.

What is claimed is:

1. An assembly for tamping ballast supporting a track having two rails extending in a longitudinal direction which are fastened to a succession of ties, the tamping assembly comprising (a) a vertically adjustable tamping tool carrier, (b) a pair of tamping tools mounted on the carrier for reciprocation towards and away from one another in the longitudinal direction, each of the tamping tools being pivotal about a swivel axis extending in the direction of elongation of the ties and including (1) at least one tamping pick arranged at the lower end of the tamping tool and intended for immersion in the ballast upon vertical adjustment of the tamping tool carrier, the tamping pick being mounted on the tamping tool for pivoting about a pivot axis extending perpendicularly to the swivel axis, (2) a pivot drive designed as a hydraulic cylinder and connected to the tamping pick for pivoting the same in the direction of elongation of the ties, and (3) an auxiliary drive connected to the pivot drive, (4) the pivot drive and the auxiliary drive each being linked to a respective one of two hinging points associated with the tamping tool and the tamping pick, respectively, (c) a squeezing drive for reciprocating the tamping tools in the longitudinal direction.

2. The ballast tamping assembly of claim 1, wherein the auxiliary drive is designed as a hydraulic cylinder and arranged to extend parallel to the pivot drive.

3. The ballast tamping assembly of claim 2, comprising two of said auxiliary drives arranged symmetrically with respect to a plane extending perpendicularly to the pivot axis and in the direction of elongation of the pivot drive.

4. The ballast tamping assembly of claim 3, further comprising a connecting plate mounted to the hydraulic cylinder of the pivot drive, with both auxiliary drives being fastened to the connecting plate.

5. The ballast tamping assembly of claim 1, wherein a piston stroke length of the auxiliary drive is designed for pivoting the tamping pick from a first to a second operating position.

* * * * *